US006097265A

United States Patent [19]

Chan et al.

[11] Patent Number: 6,097,265

[45] Date of Patent: Aug. 1, 2000

[54] MILLIMETER WAVE POLYMERIC WAVEGUIDE-TO-COAX TRANSITION

[75] Inventors: Steven S. Chan, Alhambra; Roger A. Davidheiser, Manhattan Beach; Alfred E. Lee; D. Ian Stones, both of Torrance, all of Calif.

[73] Assignee: TRW Inc., Redondo Beach, Calif.

[21] Appl. No.: 09/198,778

[22] Filed: Nov. 24, 1998

[51] Int. Cl.[7] ..... H01P 5/103

[52] U.S. Cl. ..... 333/26; 333/245

[58] Field of Search ..... 333/21 R, 26

[56] References Cited

U.S. PATENT DOCUMENTS

| | | | |
|---|---|---|---|
| 2,659,055 | 11/1953 | Cohn | 333/26 X |
| 4,463,324 | 7/1984 | Rolfs | 333/26 |
| 4,901,040 | 2/1990 | Ahlborn et al. | 333/26 |
| 5,212,461 | 5/1993 | Aicardi et al. | 333/26 X |

FOREIGN PATENT DOCUMENTS

| | | | |
|---|---|---|---|
| 1133631 | 1/1985 | U.S.S.R. | 333/26 |

*Primary Examiner*—Paul Gensler
*Attorney, Agent, or Firm*—Michael S. Yatsko

[57] ABSTRACT

A waveguide structure (10) that provides a transition from a polymeric waveguide (26) to a coaxial connection (48). The coaxial connection (48) includes an outer conductor (50) electrically connected to a top ground plate (36) of the waveguide (26) and an inner conductor (52) that extends into the polymeric material within the waveguide (26). The inner conductor (52) is electrically connected to a capacitive plate (56), and the capacitive plate (56) is electrically connected to an elongated conductive probe (58). The conductive probe (58) is electrically connected to a conductive post (60), which is electrically connected to a bottom ground plate (38) opposite to the top ground plate (36). The conductive probe (58) extends in a direction transverse to the propagation direction of electromagnetic waves, and acts to pick up the energy in the electromagnetic radiation. The capacitive plate (56) provides a shunt capacitance that resonates out the inductance caused by the conductive probe (58) and the inner conductor (52). The conductive probe (58) is positioned relative to a backshort surface (44) of the waveguide (26) a distance that is less than a quarter wavelength of the electromagnetic radiation of interest.

29 Claims, 2 Drawing Sheets

MILLIMETER WAVE POLYMERIC WAVEGUIDE-TO-COAX TRANSITION

BACKGROUND OF THE INVENTION

1. Field of the Invention

This invention relates generally to a waveguide transition structure and, more particularly, to a waveguide transition probe for coupling a millimeter wave electromagnetic signal from a dielectric loaded waveguide to a coaxial connection.

2. Discussion of the Related Art

State of the art communication systems, such as radar systems, satellite communication systems, etc., that operate in millimeter wave frequencies (20 GHz–300 GHz), generally include an antenna that collects the millimeter wave radiation from air for reception purposes, and some type of millimeter wave integrated circuit (MMIC) that detects and processes the millimeter wave radiation collected by the antenna. The MMIC would include various components, such as amplifiers, diode detectors, filters, etc., depending on the particular application of the system, as would be known to those skilled in the art.

Waveguides are typically provided to direct the millimeter wave radiation collected by the antenna to the MMIC. The millimeter wave radiation generally travels in air through the waveguide, and is collected by a coaxial connection that is electrically connected to the MMIC. The waveguide and the MMIC are generally much different in size, and thus the waveguide will include transitions to reduce its size from the antenna to the coaxial connection. The various transitions through the waveguide, including the transition from the air waveguide to the coaxial connection, are such that the transitions are impedance matched to limit the losses of the collected radiation to a minimum. Because the MMIC is usually a very small component and the antenna is relatively larger for millimeter wave applications, the transition to the coaxial connection suitable for the MMIC without significant loss is difficult to obtain.

Waveguide to coax transitions are known in the art, where the waveguide is a thin rectangular member having conductive surfaces, and the coax includes an inner pin conductor and an outer conductor. In the known transition schemes from waveguide to the coax, the outer conductor is electrically connected to one conductive surface of the waveguide, and the inner conductor extends into a dielectric medium within the waveguide and contacts an opposite conductive surface. The electromagnetic waves that make up the millimeter wave radiation impinge the inner conductor and induce a current that is directed to the MMIC. Typically, the coax connections to the waveguides in the prior art are considerably larger than the MMICs to provide a suitable connection with minimal losses. Improvements can be made to reduce the size of the coax connection to the waveguide to make it more effective to be connected to the MMIC.

What is needed is a waveguide to coax transition scheme that is effective in reducing or minimizing electrical losses, can be produced at a low cost, and has a size compatible with the state of the art MMIC technology. It is therefore an object of the present invention to provide such a transition.

SUMMARY OF THE INVENTION

In accordance wit h the teachings of the present invention, a waveguide structure is disclosed that provides a transition from a polymeric waveguide to a coaxial connection. The coaxial connection includes an outer conductor electrically connected to a first ground plate of the waveguide and an inner conductor that extends into the polymeric material within the waveguide. The inner conductor is electrically connected to a capacitive plate, and the capacitive plate is electrically connected to an elongated conductive probe. The conductive probe is electrically connected to a conductive post, which is electrically connected to a second ground plate opposite to the first ground plate. The conductive probe extends in a direction transverse to the propagation direction of electromagnetic waves, and acts to pick up the energy in the electromagnetic radiation. The capacitive plate provides a shunt capacitance that resonates out the inductance caused by the conductive probe and the inner conductor. The conductive probe is positioned from a backshort surface of the waveguide a distance that is less than a quarter wavelength of the electromagnetic radiation of interest. The position and the dimensional characteristics of the probe, the capacitive plate, the inner conductor, and the conductive post are optimized such that the electromagnetic radiation of interest is impedance matched to the coax to minimize losses.

Additional objects, advantages and features of the present invention will become apparent from the following description and appended claims, taken in conjunction with the accompanying drawings.

DETAILED DESCRIPTION OF THE PREFERRED EMBODIMENTS

Figure 1:
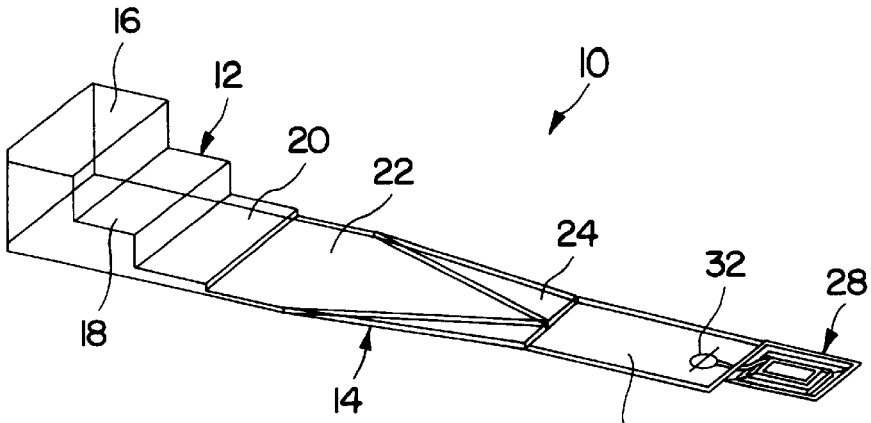
FIG. 1 is perspective plan view of a waveguide assembly including a waveguide transition structure, according to an embodiment of the present invention.

The following discussion of the preferred embodiments directed to a waveguide structure connecting a polymeric waveguide to a coaxial connection is merely exemplary in nature, and is in no way intended to limit the invention or its applications or uses. For example, the waveguide structure is described for use with millimeter waves. However, the waveguide structure has a broader use for other frequencies of interest. FIG. 1 shows a perspective view of a waveguide assembly 10 that includes a hollow stepped waveguide portion 12 and a flat waveguide portion 14. The radiation of interest, such as millimeter wave radiation at a certain bandwidth, for example Q-band, is collected by an antenna (not shown) and enters the waveguide assembly 10 at a first step transition 16 of the waveguide portion 12. A second step transition 18 of the waveguide portion 12 is impedance matched to the first step transition 16, and a third step transition 20 of the waveguide portion 12 is impedance matched to the second step transition 18. The radiation travels through air in the waveguide portion 12, and the predetermined stepped configuration of the transitions 16, 18 and 20 controls the reflections of the electromagnetic waves to reduce losses from reflections of the bandwidth of interest. This portion of the waveguide assembly 10 just described is well known in the art, and its configuration and size would depend on the particular bandwidth of interest.

The flat waveguide portion 14 includes an air portion 22 and a "V-shaped" dielectric portion 24 that is filled with a polymeric material having a known dielectric constant. The air portion 22 provides another step down transition from the third step transition 20. The configuration of the portion 22 relative to the "V-shaped" portion 24 is impedance matched, such that the bandwidth of interest travels from the portion 22 into the polymeric portion 24 with minimal losses. The radiation entering the portion 24 continues along a polymeric filled waveguide 26 that also has a dimensional shape selected based on the dielectric constant of the polymeric material and the bandwidth of interest. The waveguide 26 is relatively thin compared to the width and length of the waveguide 26. The radiation passing through the waveguide assembly 10 is received by an MMIC 28 that is a particular integrated circuit depending on the specific application, and forms no part of the present invention.

Figure 2:
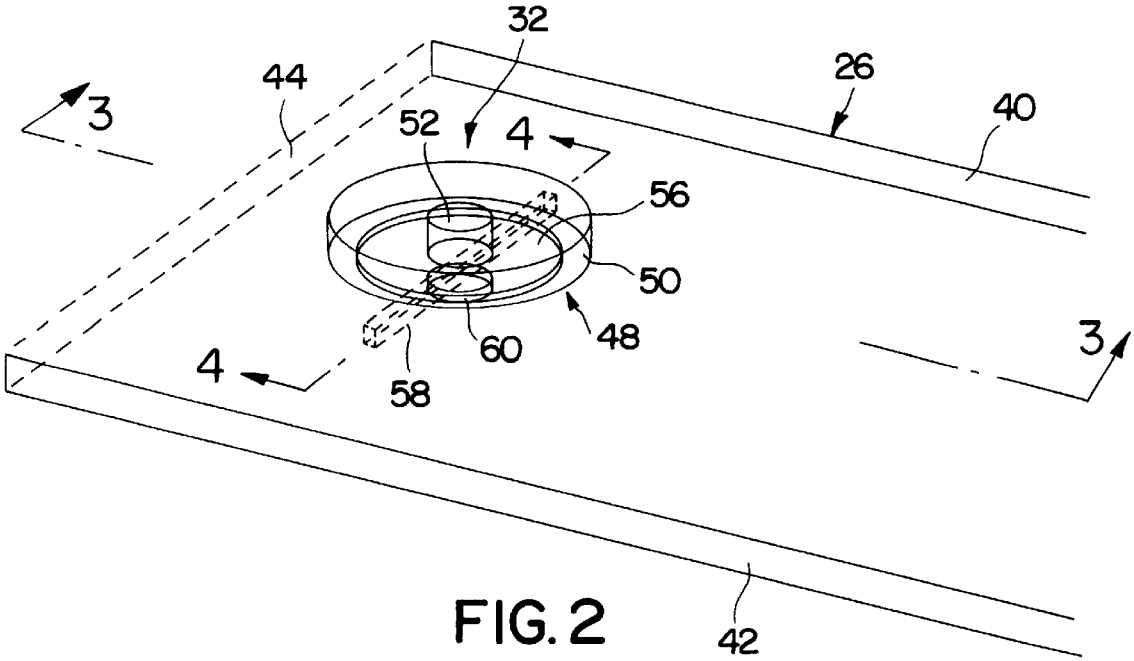
FIG. 2 is a cut-away perspective view of a portion of the waveguide assembly shown in FIG. 1, including the waveguide transition structure of the invention.
Figure 3:
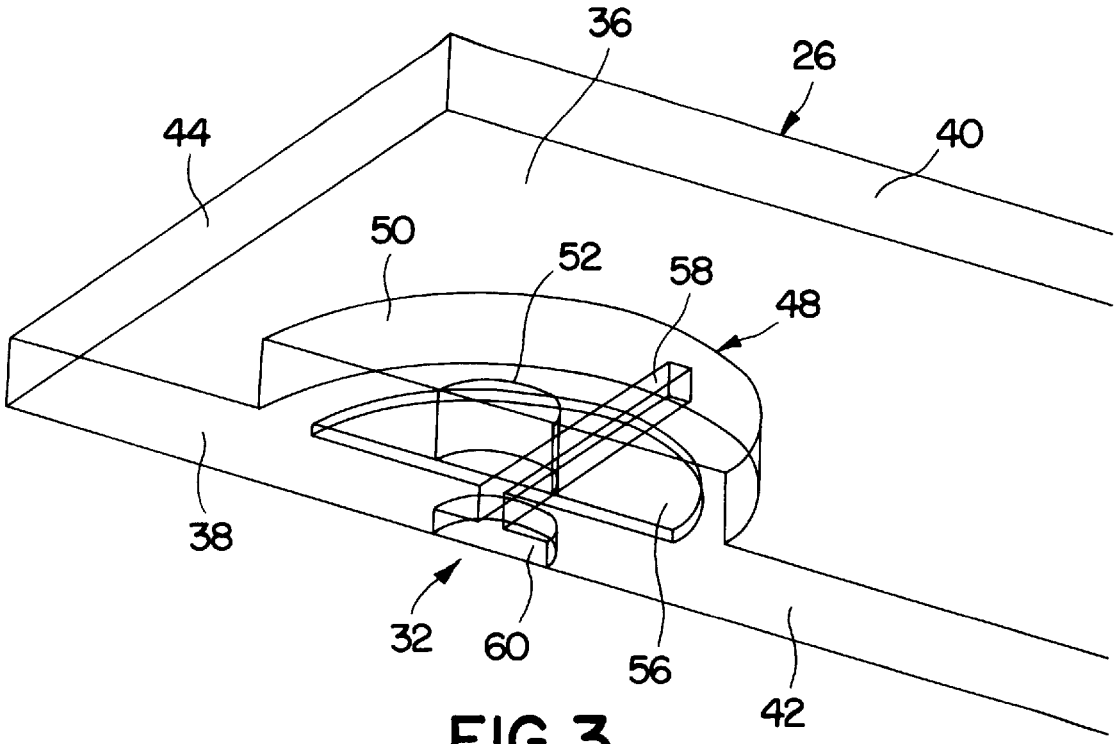
FIG. 3 is a cross-sectional view of the waveguide transition structure through line 3—3 in FIG. 2.
Figure 4:
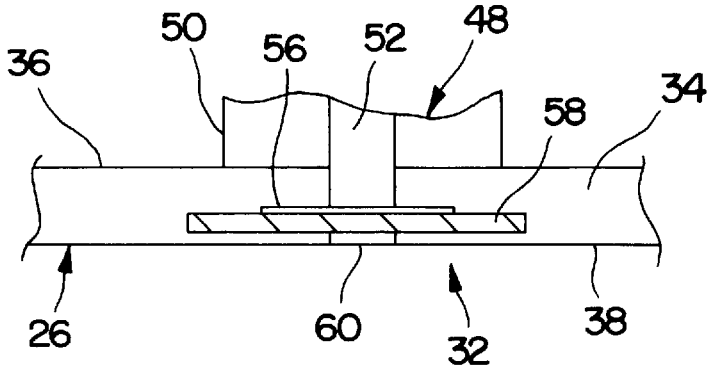
FIG. 4 is another cross-sectional view of the waveguide transition structure through line 4—4 in FIG. 2.

A transition probe assembly 32, according to an embodiment of the present invention, provides an electrical transition for electromagnetic radiation of interest propagating through the polymeric waveguide 26 to a coaxial connection that is connected to the MMIC 28, with minimal losses for the radiation of interest, and at a size consistent with current MMIC technology. FIG. 2 shows a perspective view of a portion of the polymeric waveguide 26 showing the detail of the probe assembly 32. FIG. 3 shows a cross-sectional view through line 3—3 of FIG. 2, and FIG. 4 shows a cut-away cross-sectional view through line 4—4 of FIG. 2. FIGS. 2 and 3 show the waveguide 26 reversed from the position as shown in FIG. 1. The polymeric waveguide 26 is filled with a polymeric dielectric material 34 and includes a top metallized ground plate 36, a bottom metallized ground plate 38, a first side metallized surface 40, a second side metallized surface 42, and a backshort metallized surface 44. The waveguide 26 can be metallized with any suitable conductive metal, such as aluminum, copper or gold. A polymeric dielectric is used by way of a non-limiting example because polymers are low cost and readily manufacturable. Other dielectric materials may also be applicable as a waveguide in accordance with the invention.

The electromagnetic waves from the waveguide portion 14 enter the polymeric waveguide 26 and propagate through the polymeric material towards the backshort surface 44. The electric field lines of the electromagnetic waves extends in a vertical direction with respect to the propagation direction of the waves, and the magnetic field lines extend in a horizontal direction with respect to the propagation of the waves. The electromagnetic waves reflect off of the metallized surfaces of the waveguide 26 as they propagate along the waveguide 26.

The electromagnetic waves impinge the probe assembly 32 and induce a current in the assembly 32 that is transferred to a coaxial cable 48. The coaxial cable 48 includes an outer conductor 50 in electrical contact with the top metallized ground plate 36, and an inner pin conductor 52 that extends into the polymeric material 34 of the waveguide 26 a certain distance. The outer conductor 50 and the inner conductor 52 are electrically connected to the MMIC 28. In one embodiment, the outer conductor is 41 mils in diameter and the inner conductor is 10 mils in diameter to be suitable for the MMIC 28. The probe assembly 32 includes a combination of electrical components, as will be discussed in more detail below, that provide impedance matching of the electromagnetic waves travelling down the waveguide 26 to the impedance of the coaxial cable 48 to minimize losses.

The probe assembly 32 includes a circular-shaped thin capacitive plate 56, a rectangular conductive bar 58 and a cylindrical conductive post 60, each embedded within the polymeric material. The inner pin conductor 52 is electrically connected to the capacitive plate 56, the plate 56 is electrically connected to the bar 58, the bar 58 is electrically connected to the post 60, and the post 60 is electrically connected to the bottom ground plate 38. The capacitive plate 56 defines a capacitance with the ground plate 38. The conductive bar 58 is an extension of the inner conductor 52 and extends in a direction transverse to the propagation of the electromagnetic waves, and thus effectively picks up the energy of the electromagnetic waves propagating through the waveguide 26. The size of the bar 58 is set to provide impedance matching to the coaxial cable 48, and the length of the bar 58 will generally be slightly longer than the diameter of the outer conductor 50. The capacitive plate 56 provides a shunt capacitance that resonates out the inductance created by the conductive bar 58 and the inner conductor 52. In this configuration, the ground plate 38 should have the same RF and DC conductivity as the bar 58.

By properly dimensioning each of the capacitive plate 56, the bar 58 and the post 60 relative to a particular center frequency of interest in the bandwidth, electromagnetic energy in the waves propagating through the waveguide 26 provides a current in the coaxial cable 48 with minimal power losses. The specific shape of the plate 56, the bar 58 and the post 60 is by way of a non-limiting example in that other shapes can also be provided as long as the capacitive plate 56 is a thin planar member, and the bar 58 is an elongated member. In an alternate embodiment, the capacitive plate 56 and the bar 58 can be combined into a single member, such as an elongated oval shape. The electromagnetic waves propagating down the waveguide 26 through the polymeric material contact the bar 58, and the electric field lines induce a current in the bar 58 in a vertical direction. Current is also induced by the electric field lines impinging the inner conductor 52 and the post 60. The electromagnetic waves that are not absorbed by the probe assembly 32 continue to propagate down the waveguide 26, are reflected off of the backshort surface 44 and are directed back towards the probe assembly 32. This reflection creates a different magnetic field on one side of the bar 58 than on the other side of the bar 58. This difference in magnetic field also creates a vertical current in the bar 58. The difference in the magnetic fields defines the current density in the bar 58, and this current density is then integrated over the area of the bar 58. The distance between the backshort surface 44 and the bar 58 is selected to eliminate the impedance caused by the backshort surface 44, and has to be less than a quarter wavelength of the center frequency of the radiation of interest.

The operation of the waveguide 26 and the probe assembly 32 can be summed up as follows. The incoming electromagnetic waves propagating through the waveguide 26 are incident on the probe assembly 32. The probe assembly 32 is shorted out on the backshort surface 44. Both the electric field and magnetic field of the electromagnetic waves induce a current along the length of the bar 58. The input impedance of the probe assembly 32 is zero proximate the end where it is shorted by the backshort surface 44. However, its input impedance increases as the reference plane is moved upwards to the point of entry of the probe assembly 32 into the waveguide 26. For normal sized waveguides, this input impedance at the probe entrance is sufficiently near the required value in the strip line or coaxial medium to which the probe assembly 32 transitions. However, for a very thin waveguide, such as used in polymeric fabrication, the waveguide height between the ground plates 36 and 38 can be as small as 0.006 inches. The input impedance to the probe assembly 32 at its entry to the waveguide 26 in this case is very low. Therefore, it has an inductive component. By parallel resonating this inductance by the bar 58 and the plate 56, the input impedance of the probe assembly 32 at the waveguide entrance can be raised to a useful value and provide a matched transition.

The width of the dielectric loaded waveguide 26 is calculated as a function of the frequency of interest relative to the dielectric constant ($\epsilon_r$) of the polymeric material 34. For a broad band application, the length of the conductive bar 58, the diameter of the capacitive plate 56 and the backshort distance are determined so that, in the frequency of interest, the input impedance, i.e., the thickness of the dielectric loaded waveguide 26, is fairly constant and remains very small in size. In an embodiment for Q-band wavelengths, the dielectric material of the waveguide 26 has a relative permittivity of 2.9, and an electric loss tangent of 0.002. The conductive bar 58 has a length of 0.056 inches, a width of 0.002 inches and a height of 0.003 inches. The diameter of the capacitive plate 56 is 0.032 inches and its thickness is 0.001 inches. The distance of the backshort is 0.043 inches, and the conductive post 60 has a diameter of 0.01 inches and a thickness 0.002. The size of the waveguide 26 is 0.131 in width and 0.006 inches in height.

In one embodiment, to fabricate the combination waveguide 26 and probe assembly 32 discussed above, a thin polymer layer is first deposited on the ground plate 38 either by spin coating or by vapor phase deposition. After the polymer layer is cured, a radial window is etched through the polymer that is connected to the ground plate 38. The window is horizontally positioned at the backshort distance. The window is electroplated with gold to a height level to the adjacent polymeric layer. Next, a second thin level of polymer is deposited. A window is etched and electroplated with gold in the second polymeric level, with the dimensions of the window determining the dimensions of the bar 58. The window is located to provide electrical conductivity to the window in the first level polymeric layer. Further, this window is positioned to use the sidewall of the polymeric material as the electrical backshort. This positioning allows the bar 58 to have a precision located backshort because the bar 58 alignment can be photolithographically aligned within microns of the desired backshort dimensions. This metal window will have the same DC and RF electrical conductivity as the ground plate 38.

Next, a third level of polymer is deposited. A radial window is etched and electroplated with copper, connecting to the bar 58. The electroplated radial plate 56 provides millimeter wave signal matching between the conductive bar 58 and the coaxial upper level connection. Then, a fourth level of polymer is deposited. A radial window is etched and electroplated with copper, with the dimensions of this radial window determined by the impedance matching needed between the bar 58 and the outer conductor 50. A metal layer is then deposited over the substrate with the window etched for the coaxial connection to provide the RF and the DC ground for the coaxial connection and the top ground plate 36 of the polymeric waveguide 26. Even though both the bottom ground plate 38 and the top ground plate 36 have the same DC electric potential, and are physically connected together, each plate 36 and 38 is not connected at millimeter wave frequencies because of the wave propagation direction. The bar 58 dimensions are optimized to have a simulated performance with greater than 15 dB return loss across a 20% bandwidth.

The foregoing discussion discloses and describes merely exemplary embodiments of the present invention. One skilled in the art will readily recognize from such discussion, and from the accompanying drawings and claims, that various changes, modifications and variations to be made therein without departing from the spirit and scope of the invention as defined in the following claims.

What is claimed is:

1. A waveguide structure for coupling electromagnetic radiation to a coaxial connection, said coaxial connection including an inner conductor and an outer conductor, said structure comprising:

a waveguide receiving the electromagnetic radiation, said waveguide including at least one surface being formed of a conductive metal and defining a ground plate, said outer conductor of said coaxial connection being connected to the conductive ground plate; and a probe positioned within the waveguide, said probe including a capacitive portion and an elongated conductive member, said capacitive portion defining a capacitance with the ground plate, said inner conductor of the coaxial connection being electrically connected to the probe so that the elongated conductive member extends in a direction substantially perpendicular to the inner conductor and transverse to the propagation direction of the electromagnetic radiation so that the electromagnetic radiation induces a current in the conductive member that is transferred to the inner conductor and the capacitive portion provides a shunt capacitance that resonates out the inductance created by the conductive member.

2. The structure according to claim 1 wherein the waveguide is filled with a polymeric material of a known dielectric constant.

3. The structure according to claim 2 wherein the probe is embedded within the polymeric material.

4. The structure according to claim 1 wherein the capacitive portion is a circular plate, and the conductive member is a rectangular conductive member.

5. The structure according to claim 4 wherein the inner conductor is electrically connected to the capacitive plate and the capacitive plate is electrically connected to the conductive member.

6. The structure according to claim 4 wherein the circular capacitive plate has a diameter less than the diameter of the outer conductor.

7. The structure according to claim 1 wherein the elongated conductive member has a length that is greater than the diameter of the outer conductor.

8. The structure according to claim 1 wherein the probe is positioned within the waveguide at a distance relative to a conductive backshort surface of the waveguide that is less than one-quarter wavelength of a center frequency of the electromagnetic radiation of interest.

9. The structure according to claim 1 wherein the probe further includes a metal post electrically connected to the conductive member and another conductive ground plate of the waveguide opposite to the ground plate that is connected to the outer conductor.

10. The structure according to claim 1 wherein the waveguide includes a first conductive ground plate electrically connected to the outer conductor and a second conductive ground plate substantially parallel to the first ground plate and electrically connected to the inner conductor, wherein the distance between the first and second ground plates is about 0.006 inches.

11. A waveguide for directing electromagnetic radiation, said waveguide comprising:

a rectangular waveguide portion including six sides defining a waveguide channel, said waveguide channel being filled with a dielectric material, wherein a first side, a second side, a third side, a fourth side and a fifth side of the waveguide portion are metallized surfaces defining ground plates, said first side and said second side being substantially parallel and the distance between the first and second side is about 0.006 inches, said electromagnetic radiation entering the waveguide portion through a sixth side and propagating towards the fifth side, said fifth side being a waveguide backshort;

a coaxial connection including an outer conductor and an inner conductor, said outer conductor being in electrical contact with the first side ground plate and said inner conductor extending into the dielectric material; and a probe assembly providing an electrical transition for the electromagnetic radiation from the waveguide portion to the coaxial connection, said probe assembly including an elongated probe member embedded in the dielectric material and extending in a direction transverse relative to the propagation direction of the electromagnetic radiation, said probe member being in electrical contact with the inner conductor, said electromagnetic radiation inducing a current in the probe member that is transferred to the coaxial connection.

12. A waveguide for directing electromagnetic radiation, said waveguide comprising:

a rectangular waveguide portion including six sides defining a waveguide channel, said waveguide channel being filled with a dielectric material, wherein a first side, a second side, a third side, a fourth side and a fifth side of the waveguide portion are metallized surfaces defining ground plates, said first side and said second side being substantially parallel, said electromagnetic radiation entering the waveguide portion through a sixth side and propagating towards the fifth side, said fifth side being a waveguide backshort;

a coaxial connection including an outer conductor and an inner conductor, said outer conductor being in electrical contact with the first side ground plate and said inner conductor extending into the dielectric material;

a probe assembly providing an electrical transition for the electromagnetic radiation from the waveguide portion to the coaxial connection, said probe assembly including an elongated probe member embedded in the dielectric material and extending in a direction transverse relative to the propagation direction of the electromagnetic radiation, said probe member being in electrical contact with the inner conductor, said electromagnetic radiation inducing a current in the probe member that is transferred to the coaxial connection; and a conductive post, said conductive post being electrically connected to the second side ground plate and the elongated probe member.

13. A waveguide for directing electromagnetic radiation, said waveguide comprising:

a rectangular waveguide portion including six sides defining a waveguide channel, said waveguide channel being filled with a dielectric material, wherein a first side, a second side, a third side, a fourth side and a fifth side of the waveguide portion are metallized surfaces defining ground plates, said first side and said second side being substantially parallel, said electromagnetic radiation entering the waveguide portion through a sixth side and propagating towards the fifth side, said fifth side being a waveguide backshort;

a coaxial connection including an outer conductor and an inner conductor, said outer conductor being in electrical contact with the first side ground plate and said inner conductor extending into the dielectric material; and a probe assembly providing an electrical transition for the electromagnetic radiation from the waveguide portion to the coaxial connection, said probe assembly including an elongated probe member embedded in the dielectric material and extending in a direction transverse relative to the propagation direction of the electromagnetic radiation and being substantially perpendicular to the inner conductor, said probe member being in electrical contact with the inner conductor, said electromagnetic radiation inducing a current in the probe member that is transferred to the coaxial connection.

14. The waveguide according to claim 13 wherein the probe assembly further includes a capacitive plate, said capacitive plate defining a capacitance with at least one of the ground plates, said capacitive plate being embedded in the dielectric material and being in electrical contact with the inner conductor and the elongated probe member, said capacitive plate providing a shunt capacitance that resonates out the inductance created by the probe member.

15. The waveguide according to claim 14 wherein the elongated probe member is a rectangular shaped member and the capacitive plate is a circular plate.

16. The waveguide according to claim 14 wherein the outer conductor has a diameter greater than the diameter of the capacitive plate.

17. The waveguide according to claim 13 wherein the dielectric material is a polymeric material.

18. The waveguide according to claim 13 wherein the elongated member has a length greater than the diameter of the outer conductor.

19. The waveguide according to claim 13 wherein the distance between the first and second sides is about 0.006 inches.

20. The waveguide according to claim 13 wherein the distance between the probe assembly and the waveguide backshort is less than one-quarter the wavelength of the electromagnetic radiation of interest.

21. The waveguide according to claim 13 further comprising a conductive post, said conductive post being electrically connected to the second side ground plate and the elongated probe member.

22. A waveguide coupling structure for coupling electromagnetic radiation to a coaxial connection, said structure comprising a probe assembly including a capacitive portion and an elongated probe member, said capacitive portion defining a capacitance with a ground plate of the waveguide structure, said elongated probe member extending in a direction transverse to the propagation direction of the electromagnetic radiation and perpendicular to an inner conductor of the coaxial connection, said electromagnetic radiation inducing a current in the probe member, said capacitive portion providing a shunt capacitance that resonates out the inductance created by the probe member.

23. The structure according to claim 22 wherein the elongated probe member is a rectangular shaped member and the capacitive portion is a capacitive plate electrically connected to the probe member.

24. The structure according to claim 23 wherein the probe assembly is embedded in a dielectric material within a waveguide.

25. A method for coupling electromagnetic radiation to a coaxial connection, said coaxial connection including an inner conductor and an outer conductor, said method comprising the steps of:

providing a waveguide receiving the electromagnetic radiation, said waveguide including at least one surface being formed of a conductive metal and defining a ground plate, said outer conductor of said coaxial connection being connected to the conductive ground plate; and providing a probe positioned within the waveguide, said probe including a capacitive portion and an elongated conductive member, said capacitive portion defining a capacitance with the ground plate, said inner conductor of the coaxial connection being electrically connected to the probe so that the elongated conductive member extends in a direction substantially perpendicular to the inner conductor and transverse to the propagation direction of the electromagnetic radiation so that the electromagnetic radiation induces a current in the conductive member that is transferred to the inner conductor and the capacitive portion provides a shunt capacitance that resonates out the inductance created by the conductive member.

26. The method according to claim 25 wherein the step of providing a waveguide includes providing a waveguide filled with a polymeric material of a known dielectric constant.

27. The method according to claim 26 wherein the step of providing a probe includes embedding the probe within the polymeric material.

28. The method according to claim 25 wherein the step of providing a probe includes providing a probe that includes a circular capacitive plate and a rectangular elongated conductive member.

29. The method according to claim 25 further comprising the step of positioning the probe within the waveguide so that the length of the conductive member extends in a transverse direction relative to the propagation direction of the electromagnetic radiation in the waveguide.

* * * * *